US010864766B2

(12) United States Patent
McBride, Jr. et al.

(10) Patent No.: US 10,864,766 B2
(45) Date of Patent: Dec. 15, 2020

(54) SPIRAL ART DEVICE

(71) Applicant: Crayola, LLC, Easton, PA (US)

(72) Inventors: John D. McBride, Jr., Easton, PA (US); Christopher P. Orem, Easton, PA (US); Thomas R. Rau, Easton, PA (US)

(73) Assignee: Crayola, LLC, Easton, PA (US)

( * ) Notice: Subject to any disclaimer, the term of this patent is extended or adjusted under 35 U.S.C. 154(b) by 253 days.

(21) Appl. No.: 16/033,772

(22) Filed: Jul. 12, 2018

(65) Prior Publication Data

US 2019/0023059 A1 Jan. 24, 2019

Related U.S. Application Data

(60) Provisional application No. 62/533,909, filed on Jul. 18, 2017.

(51) Int. Cl.

| | |
|---|---|
| ***B43L 13/24*** | (2006.01) |
| ***B43L 11/06*** | (2006.01) |
| ***B43L 13/20*** | (2006.01) |

(52) U.S. Cl.

CPC ..... *B43L 13/24* (2013.01); *B43L 11/06* (2013.01); *B43L 13/205* (2013.01)

(58) Field of Classification Search

CPC ..... B43L 11/06; B43L 13/205; B43L 13/24; F16H 31/00

USPC ..... 434/87

See application file for complete search history.

(56) References Cited

U.S. PATENT DOCUMENTS 3,933,315 A * 1/1976 Popeil ..... A47J 42/34 241/166

5,473,854 A * 12/1995 Demarest ..... A61B 17/06133 53/116

FOREIGN PATENT DOCUMENTS

DE 202008012989 U1 * 1/2009 ..... B43L 13/205

* cited by examiner

*Primary Examiner* — James B Hull
*Assistant Examiner* — Jennifer L Korb
(74) *Attorney, Agent, or Firm* — Shook, Hardy and Bacon LLP

(57) ABSTRACT

The technology described herein relates to a spiral art device that allows a user to create and recreate spiral art designs with chalk, and in particular with sidewalk chalk. The spiral art device in accordance with aspects herein comprises one or more stencil pieces and a motor piece. The motor piece is configured to move the stencil piece a predetermined distance around the motor piece, as many times as desired to form the spiral art design. The stencil piece is configured to have multiple securing points that allow the stencil piece to be secured to the motor piece at different angles, further allowing the user to add additional variations to their spiral art design. Design variations may be exponentially multiplied when multiple stencils having differently shaped traceable margins are provided with the spiral art device in accordance with aspects herein.

20 Claims, 9 Drawing Sheets

SPIRAL ART DEVICE

CROSS-REFERENCE TO RELATED APPLICATIONS

This is a Nonprovisional application that claims the benefit of U.S. Provisional Application No. 62/533,909, titled "Spiral Art Device," filed on Jul. 18, 2017, which is hereby expressly incorporated by reference in its entirety herein.

STATEMENT REGARDING FEDERALLY SPONSORED RESEARCH OR DEVELOPMENT

Not applicable.

TECHNICAL FIELD

Aspects of the technology described herein relate to a device for making spiral art.

BACKGROUND

Traditionally, chalk has been used to draw, write, play, and the like, for education as well as entertainment. Sidewalk chalk in particular provides a fun source of entertainment, which encourages free expression and imagination. However, chalk art, and in particular sidewalk chalk art, is only temporary and is meant to be washed away by environmental elements or simply by the application of water. One has little or no ability to recreate an image or artwork exactly as before because these are mostly made free-hand. Therefore, if the image or artwork is washed away, there is no way to recreate the image or artwork. Further, free-hand chalk art oftentimes creates frustration amongst younger users because they are not able to create an image exactly the way they want to or because they do not have sufficient motor skills developed due to their young age (e.g., toddler artists); however, these factors may also be true for other groups of people (e.g., elementary school children, teenagers, or even adults). The spiral art device, in accordance with aspects herein, provides a vehicle for any person, regardless of their skill level, to create and recreate fun images that push the boundaries of imagination further.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The technology described herein generally relates to a spiral art device.

The technology described herein is directed to a spiral art device and a method of assembling and using the spiral art device. The spiral art device, in accordance with aspects herein, generally comprises a removable and exchangeable stencil piece and a movement or motor piece, which is configured to move the stencil piece a predetermined distance for creating a series of overlapping chalk markings that result in unique chalk designs. Each stencil piece may comprise one or more traceable openings, one or more traceable edges, and at least one pair of locking openings that serve to lock the stencil piece to the motor piece.

The spiral art device, in accordance with aspects herein, allows a user to create and recreate designs with chalk, and in particular sidewalk chalk, as will be further discussed below. Additional objects, advantages, and novel features will be set forth in part in the description which follows, and in part will become apparent to those skilled in the art upon examination of the following, or may be learned by practice of the technology described herein.

BRIEF DESCRIPTION OF THE SEVERAL VIEWS OF THE DRAWINGS

The technology described herein is described in detail below with reference to the attached drawing figures, wherein.

DETAILED DESCRIPTION

The spiral art device, in one aspect, comprises at least one removable and exchangeable stencil piece and a motor piece. The motor piece is configured to move the stencil piece a predetermined distance from its starting point each time it is activated. The stencil piece generally comprises at least one traceable opening and at least two locking openings, where the traceable opening is traceable with a chalk piece (e.g., sidewalk chalk, chalkboard chalk, and the like). However, it is also contemplated that the spiral art device may be used for making designs with any other type(s) of writing instrument(s) such as, for example, pens, markers, crayons, pencils, oil pastels, and the like. Thus, the scale of the spiral art device in accordance with aspects herein may be modified accordingly to be useable with the respective writing and/or marking material of choice. Nevertheless, in order to simplify the description of the spiral art device in accordance with aspects herein, the spiral art device will be described as being used with chalk as an illustrative example.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Figure 1:
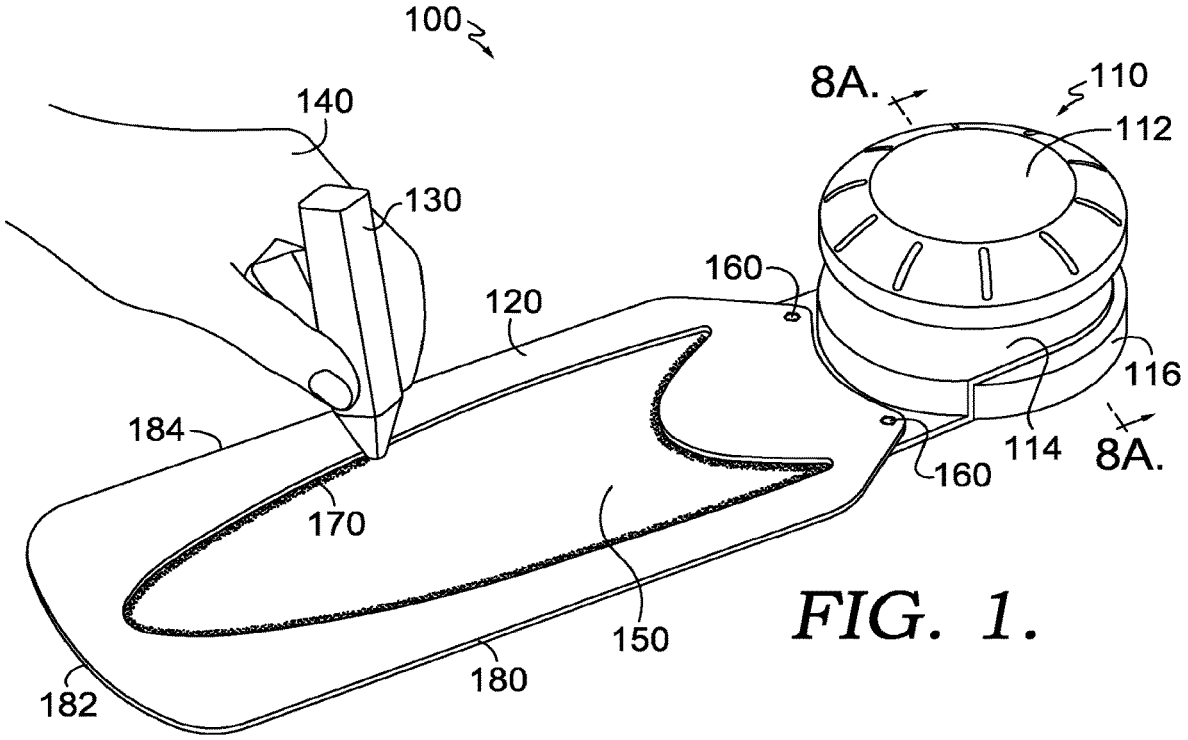
FIG. 1 depicts a perspective view of a user using the spiral art device in an initial position, in accordance with aspects herein.
Figure 6:
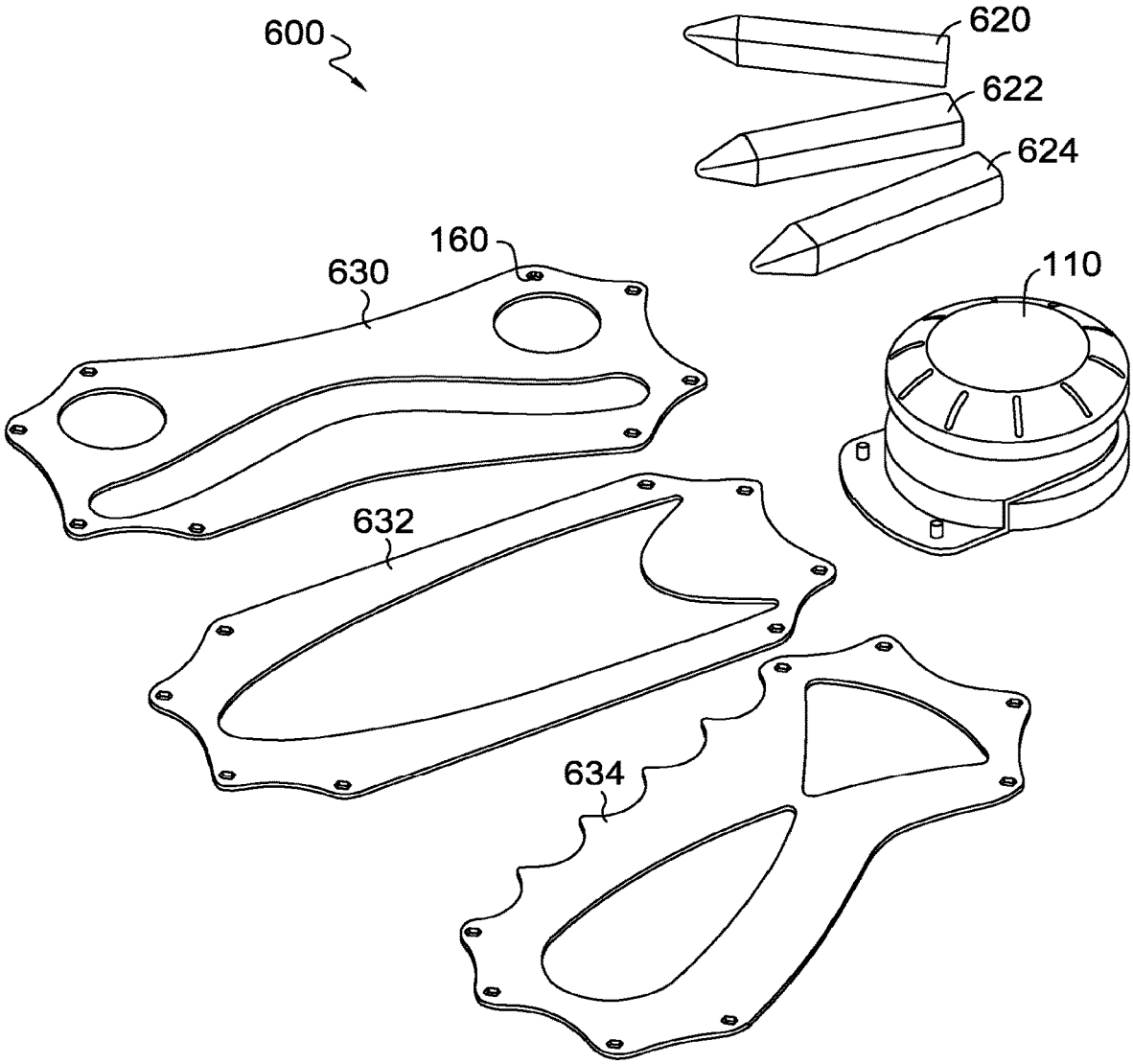
FIG. 6 depicts a perspective view of an exemplary spiral art device system kit, in accordance with aspects herein.

The spiral art device, in accordance with aspects herein, allows a user to create and recreate chalk designs by providing a device that allows a user to make markings on a receiving surface (e.g., paper, sidewalk, and the like) in a controlled manner. As seen in FIG. 1, the spiral art device 100 in accordance with aspects herein comprises motor piece 110 and a stencil piece 120. The stencil piece 120 shown is only exemplary and many other configurations are available without departing from the aspects disclosed herein. For example, other exemplary configurations are shown in FIG. 6. As shown in FIG. 1, each stencil piece 120 comprises at least one traceable opening 150 and at least two locking openings 160 for securing the stencil piece 120 to the motor piece 110. Further, the perimeter edges 180, 182, and 184 may also be traced by a user 140 with the marking device 130, shown as being a piece of chalk in FIG. 1. As such, the perimeter edges 180, 182, and 184 may be straight (as shown), curved, wavy, jagged, and the like. When a user 140 traces the traceable opening 150, the user 140 is able to make a marking 170 (i.e., draw a shape closely corresponding to the shape of the traceable opening 150) on the receiving surface, which may be any surface chosen by the user (e.g., sidewalk, cardboard, paper, chalkboard, and the like). The traceable opening 150 may be of any desired shape such as a geometric shape, an organic shape, a logo, a letter, and the like. The locking openings 160 may comprise any shape such as circular, square, rectangular, oval, hexagonal, and the like. In preferred embodiments, the locking openings 160 are hexagonal. The locking openings 160 serve to lock the stencil piece 120 to the motor piece 110 so that the motor piece 110 is able to controllably move the stencil piece 120 a predetermined rotational distance from its staring point around the motor piece 110.

The stencil piece 120, in accordance with aspects herein, may be comprised of any rigid or semi-rigid material such as plastic, metal, wood, glass, synthetic foam, and the like. Suitable synthetic materials may be, for example, synthetic polymer materials that are rigid or semi-rigid at room temperature such as, for example, polypropylene, polyethylene, thermoplastic polyurethane, silicone, polyurethane foam, and the like. In accordance with aspects herein, any rigid or semi-rigid material may be any material that is able to consistently maintain its shape and is not prone to deformation at room temperature. Further, the thickness of the stencil piece 120 may range, for example, between 0.1 mm and 10 mm, between 0.2 mm and 9 mm, between 0.3 mm and 8 mm, between 0.4 mm and 7 mm, 0.5 mm and 6 mm, 0.5 mm and 5 mm, 0.5 mm and 4 mm, 0.2 mm and 3 mm, 0.2 mm and 2 mm, 0.1 mm and 1 mm, or in other words, the stencil piece 120 may be, for example, 0.1 mm thick, 0.2 mm thick, 0.5 mm thick, 1 mm thick, 2 mm thick, 3 mm thick, and the like.

Further, the stencil piece 120, depending on the material used, may be formed, for example, by a molding process, die cutting process, woodworking process, laser cutting process, and the like. For example, in the case of plastics, a plurality of molds may be provided, each mold being suitable for molding a specific shape with a specific traceable opening for the stencil piece 120. Alternatively, a reconfigurable mold may be provided where the molding cavity of the mold may be reconfigured to have different shapes. Alternatively, the stencil piece 120 may also be formed by, for example, die cutting and/or laser cutting. For instance, a sheet or sheets of material (plastic, metal, wood, and the like) may be provided from which stencil pieces having a desired shape may be cut using a die cutting and/or a laser cutting process.

When the spiral art device 100 is in use, the stencil piece 120 is steadily moved by the motor piece 110. In one aspect, the motor piece may move the stencil piece 120 a predetermined rotational distance each time the motor piece 110 is activated by the user 140. In another aspect, the motor piece 110 may be provided with an adjustment mechanism (not shown) useable by the user to determine a desired rotational distance that the stencil piece 120 should be moved by the motor piece 110. In yet another aspect, the user 140 may be provided with a mechanism (not shown) to choose from two or more predetermined rotational distances, and the user 140 may pick and adjust as necessary from the two or more predetermined rotational distances.

Figure 2:
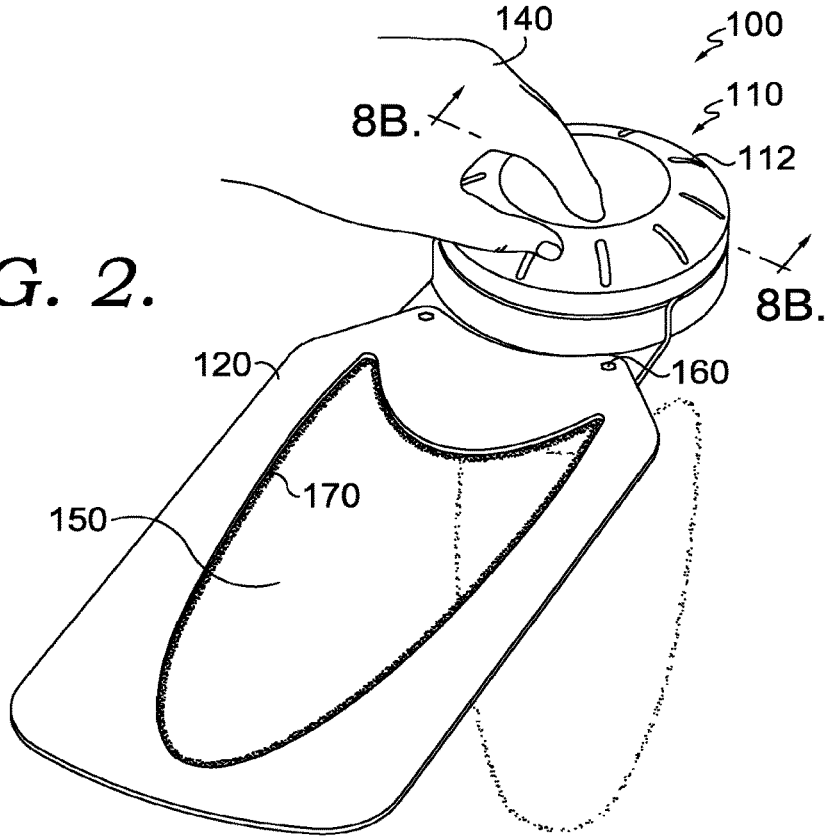
FIG. 2 depicts a perspective view of a user using the spiral art device in a subsequent position, in accordance with aspects herein.

Moving on to the motor piece 110 of the spiral art device 100, the motor piece 110, in accordance with aspects herein, may be comprised of a plunger cap member 112, a template ring member 114 configured to carry and move the stencil piece 120, and a base member 116. The stencil piece 120 is secured to the template ring member 114 of the motor piece 110. As shown in FIG. 2, in order to activate the motor piece 110, the user 140 may press down on the plunger cap member 112, which may initiate movement of the template ring member 114 carrying the stencil piece 120. Once the stencil piece 120 is moved a predetermined rotational distance from its starting point by the template ring member 114, the user 140 may make another marking by using the stencil piece 120 at the new location, and continue on until a complete trip around the motor piece 110 is made, as shown in FIG. 3, where a completed design 300 with the spiral art device 100, is shown.

Figure 3:
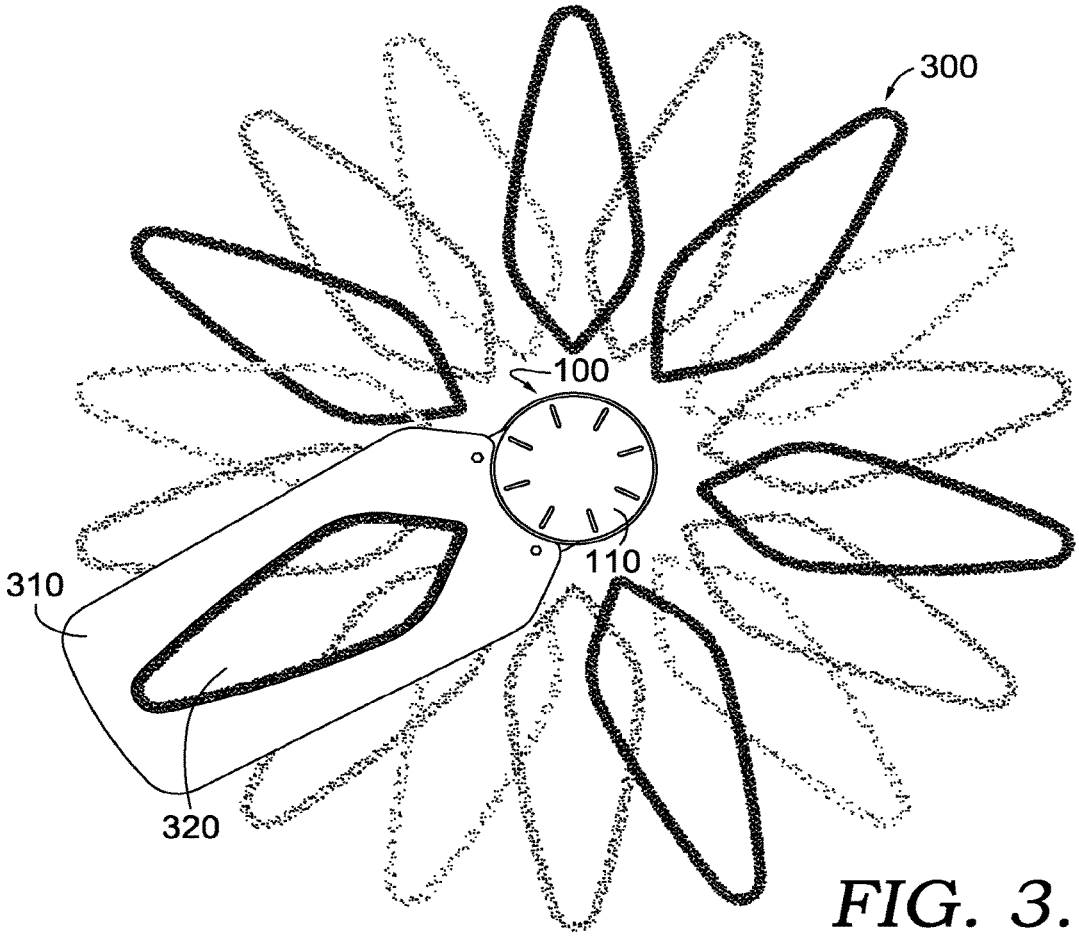
FIG. 3 depicts an exemplary chalk art design created with the spiral art device using an exemplary stencil piece, in accordance with aspects herein.

As shown in FIG. 3, the design 300 is created by the repetitive markings formed by tracing the traceable opening 320 of stencil piece 310 every time the stencil piece 310 is rotationally moved in a controlled manner around the motor piece 110. The act of layering the markings and varying the starting points help a user create visually attractive designs that can be recreated using the same stencil piece 310, when desired, thereby reducing the user's frustration caused by not being able to keep an art design, especially when the art design is meant to be temporary, for example, when it is done with chalk on, for example, a sidewalk. Further, the resulting designs made with the spiral art device 100, in accordance with aspects herein, may be so vibrant, unique, and intriguing, depending on the combination of colors and stencil pieces used, that the spiral art device 100 in accordance with aspects herein may provide healthy and creative outdoor entertainment to a user for prolonged periods of time.

Figure 4:
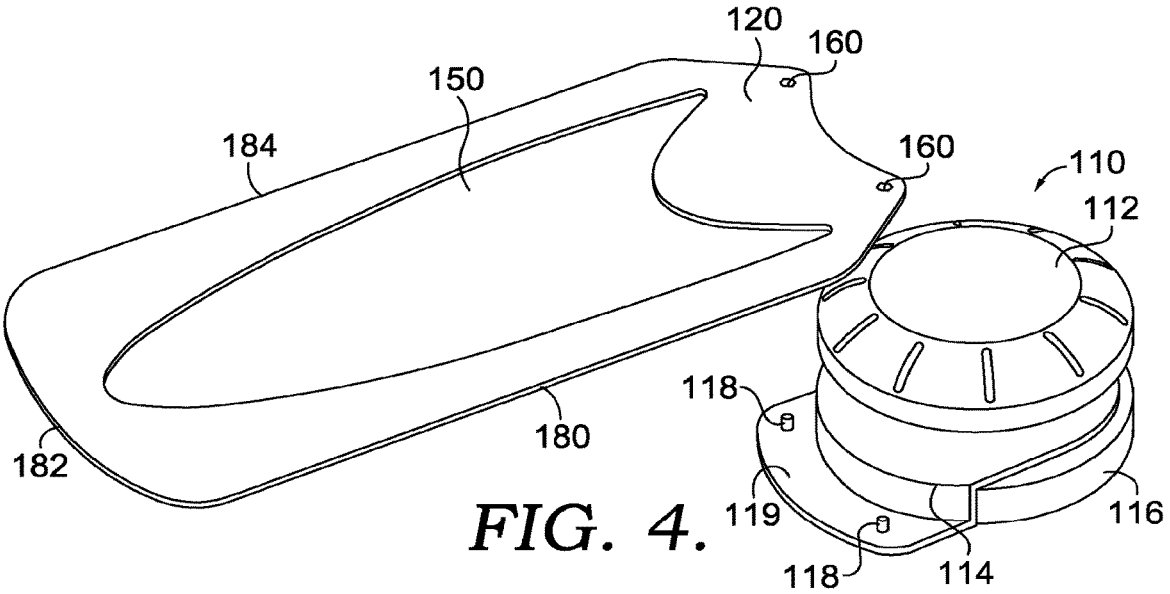
FIG. 4 depicts an exemplary stencil piece and a motor piece prior to assembly, in accordance with aspects herein.

As seen in FIG. 4, the template ring member 114 of the motor piece 110 comprises a lip portion 119 with one or more locking pins 118. In the exemplary spiral art device 100 shown, the lip portion 119 comprises two locking pins 118 that are configured to hold the stencil piece 120 and secure it to the motor piece 110. In other words, the locking pins 118 are configured to extend through the locking openings 160 of the stencil piece 120. The locking pins 118 may have a generally cylindrical shape having a circular perimeter; however, it is also contemplated that their perimeters may be hexagonal, triangular, square, and the like, suitable for securely fitting into the locking openings 160 of the stencil piece 120. As well, the height of the locking pins 118 may be no higher than five times the thickness of the stencil piece 120, no higher than four times the thickness of the stencil piece 120, no higher than three times the thickness of the stencil piece 120, no higher than two times the thickness of the stencil piece 120, or no higher than the thickness of the stencil piece 120.

Figure 5A:
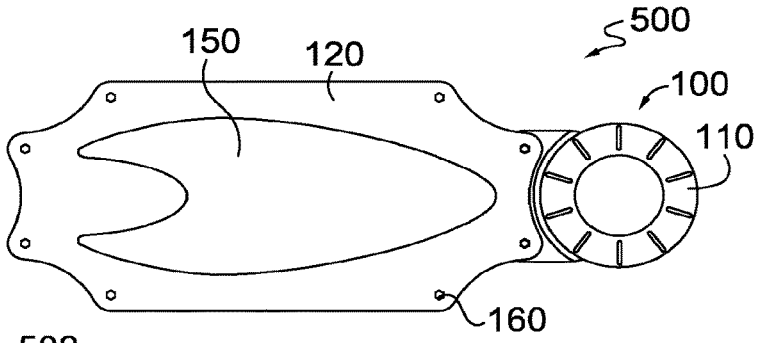
FIG. 5A depicts an exemplary stencil piece locked to the motor piece in a first configuration, in accordance with aspects herein.
Figure 5B:
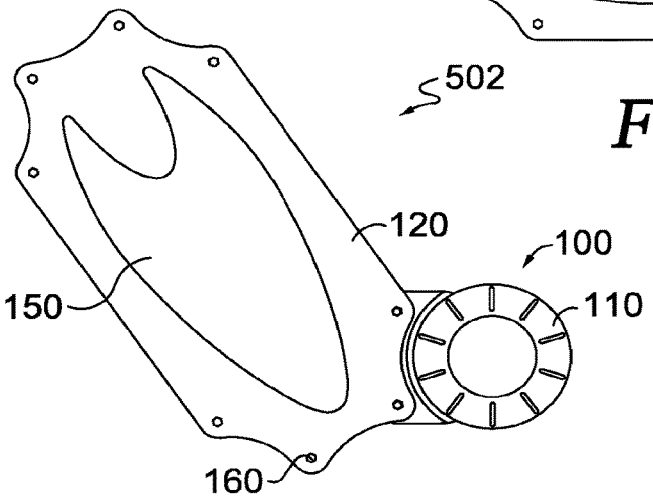
FIG. 5B depicts the exemplary stencil piece of FIG. 5A locked to the motor piece in a second configuration, in accordance with aspects herein.
Figure 5C:
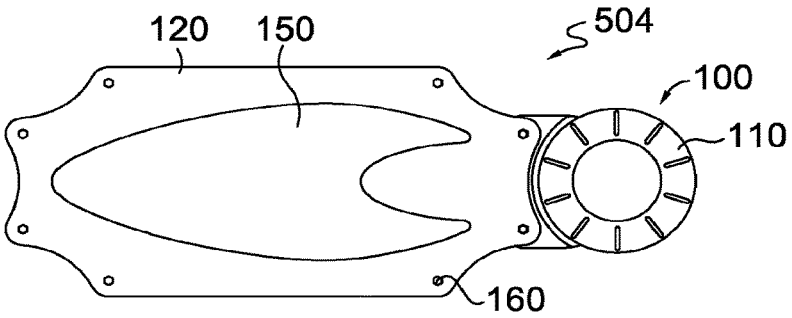
FIG. 5C depicts the exemplary stencil piece of FIG. 5A locked to the motor piece in a third configuration, in accordance with aspects herein.
Figure 5D:
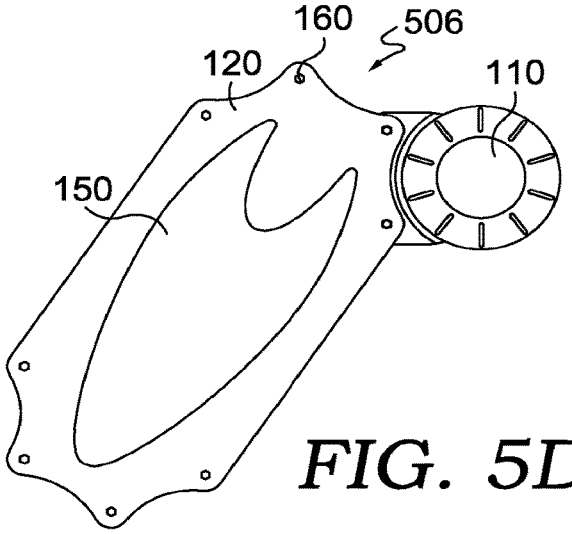
FIG. 5D depicts the exemplary stencil piece of FIG. 5A locked to the motor piece in a fourth configuration, in accordance with aspects herein.

FIGS. 5A to 5D depict a spiral art device 100 in different configurations, that further provide more variation to the designs resulting from varying the securing points of the stencil piece 120 to the motor piece 110, in accordance with aspects herein. As shown, the stencil piece 120 may comprise one or more traceable openings 150 and a plurality of locking openings 160. For example, if the stencil piece 120 is secured to the motor piece 110 in a first configuration 500 using a first pair of locking openings 160 (as shown in FIG. 5A), the traceable opening 150 may be in a first orientation; if the stencil piece 120 is secured to the motor piece 110 in a second configuration 502 using a second pair of locking openings 160 (as shown in FIG. 5B), the traceable opening 150 may be in a second orientation different from the first orientation; if the stencil piece 120 is secured to the motor piece 110 in a third configuration 504 using a third pair of locking openings 160 (as shown in FIG. 5C), the traceable opening 150 may be in a third orientation different from both the first orientation and the second orientation; if the stencil piece 120 is secured to the motor piece 110 in a fourth configuration 506 using a fourth pair of locking openings 160 (as shown in FIG. 5D), the traceable opening 150 may be in a fourth orientation different from the first orientation, the second orientation, and the third orientation; and so on. In other words, depending on which pair of locking openings 160 are used to secure the stencil piece 120 to the motor piece 110, the traceable opening(s)'s orientation may be changed, thereby offering multiple design variations possible by using one stencil piece 120.

Further, as shown in FIG. 6, the spiral art device in accordance with aspects herein may be provided as a kit 600. The kit 600 may comprise a motor piece 110, one or more chalk pieces 620, 622, and 624, and one or more stencil pieces 630, 632, and 634. The kit 600 shown in FIG. 6 is only exemplary and it is contemplated that it may be provided with more or less chalk pieces or stencil pieces than what is shown. In the case of kit 600, for example, chalk piece 620 may be a first color, chalk piece 622 may be a second color, and chalk piece 624 may be a third color, or alternatively, all chalk pieces 620, 622, and 624 may be the same color. Furthermore, as shown, each stencil piece 630, 632, and 634 may provide different traceable openings or traceable edges in addition to a plurality of locking openings 160 to provide different angles and different designing features to a user.

Figure 7A:
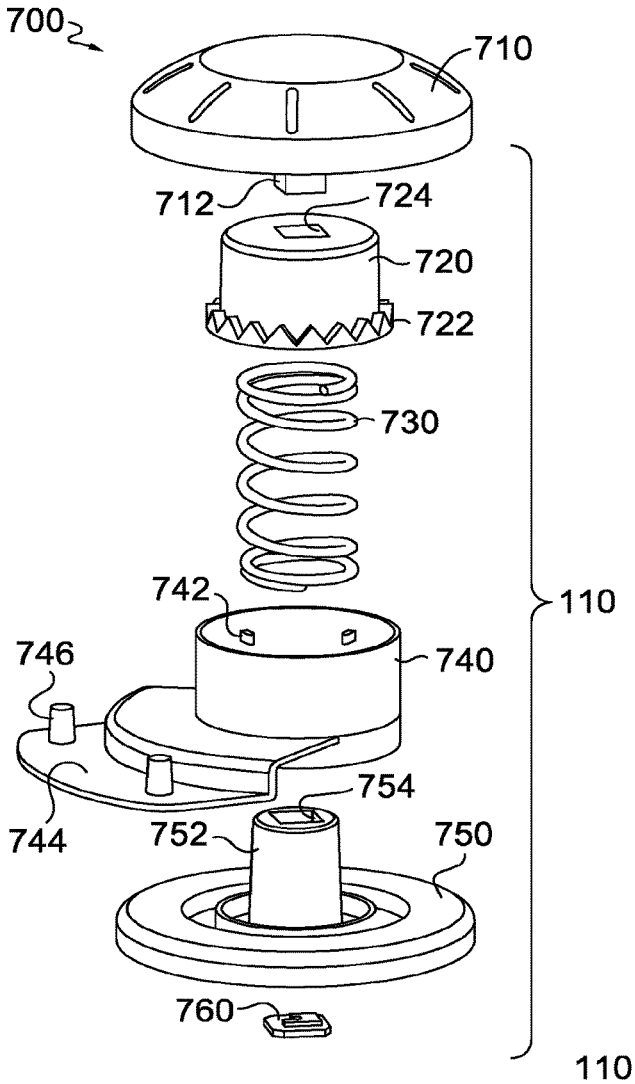
FIG. 7A depicts an exploded view of the motor piece of the spiral art device, in accordance with aspects herein.

FIG. 7A shows a first exploded view 700 that shows more detail of the construction of the motor piece 110 of the spiral art device 100 in accordance with aspects herein. As shown, the motor piece 110 is generally comprised of a plunger cap member 710, a first cam ring or a first ring member 720 having a first plurality of cams 722, a spring member 730, a template ring member 740 having a lip portion 744 with at least one locking pin 746 (configured to secure and carry the stencil piece), a base member 750, and a locking cap member 760. The plunger cap member 710, as further shown in FIG. 7B, comprises a second cam ring or a second ring member 714 comprising a second plurality of cams 716. The motor piece 110 may be assembled by setting the plunger cap member 710 upside down on a flat surface so that the second plurality of cams 716 of the second ring member 714, are pointing up. Centering the template ring member 740 over the second ring member 714 so that a plurality of ring pins 742, located on an interior surface of the template ring member 740, are engaged with the second plurality of cams 716 (the ring pins 742 are fitted into grooves of the second plurality of cams 716 of the second ring member 714. Then, the first ring member 720 may be placed in mating alignment with the second ring member 714 so that the first plurality of cams 722 of the first ring member 720 are in mating alignment with the second plurality of cams 716 of the second ring member 714. As well, for further alignment, the first ring member 720 may comprise a center opening 724 shaped and sized to closely fit a stem portion 712 of the plunger cap member 710 through the center opening 724. Then, the spring member 730 may be centered around the plunger cap member's 710 stem portion 712. Then, the base member 750 may be placed over the spring member 730 aligning a center opening 754 of a stem portion 752 with the stem portion 712 of the plunger cap member 710 such that the stem portion 712 is configured to extend through the center opening 754 of the stem portion 752. Just like the opening 724 of the first ring member 720, the center opening 754 of the stem portion 752 may be shaped and sized to closely fit the stem portion 712. Finally, the base member 750 may be pressed down and secured to the plunger cap member 710 by applying the locking cap member 760. In accordance with aspects herein, the components of the motor piece 110 may be provided with alignment mechanisms such as, for example, alignment ribs (not shown), for ensuring correct alignment of the components during assembly. Further, the above assembly steps are exemplary, and the order in which the steps are provided is not limiting because the components may be assembled in a different order, for example, starting with the base member 750 set on a flat surface and so on and so forth. Furthermore, although not shown, the base member may further be provided with gripping feet comprised of, for example, rubber, for providing a good grip on a receiving surface (e.g., paper, sidewalk, cardboard, and the like) so that the stencil piece 120 is not easily moved when a user is actively tracing the perimeter edges 180, 182, 184, or the traceable opening 150 of the stencil piece 120 to make a marking 170 with, for example, marking device 130, as shown in FIGS. 1 to 3.

Figure 7B:
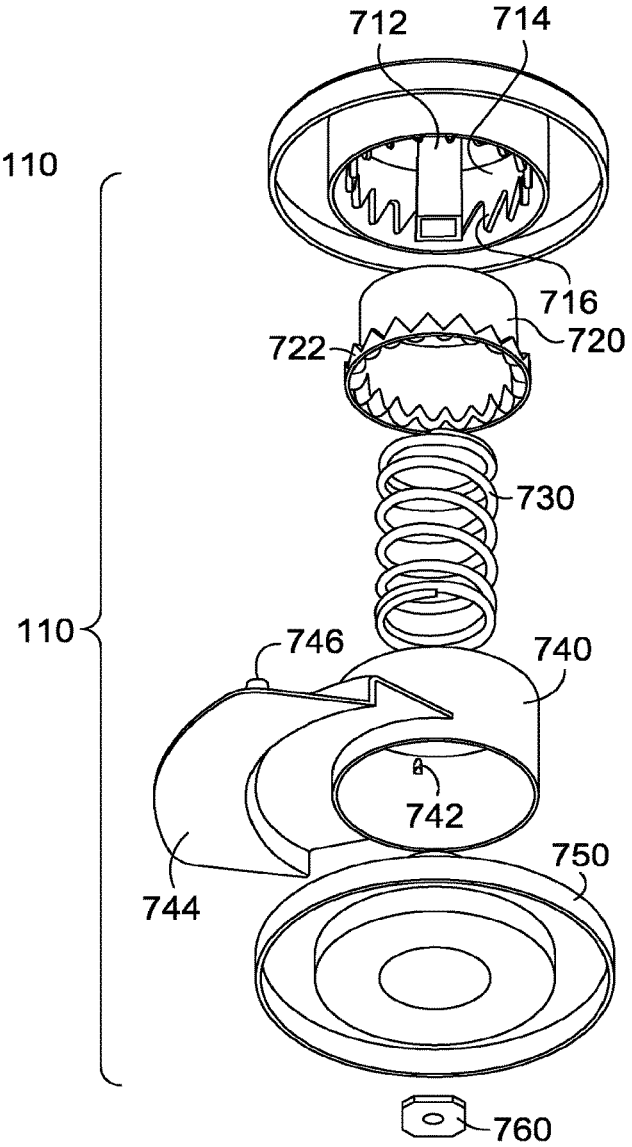
FIG. 7B depicts an angled view of the exploded view of the motor piece of the spiral art device, in accordance with aspects herein.
Figure 8A:
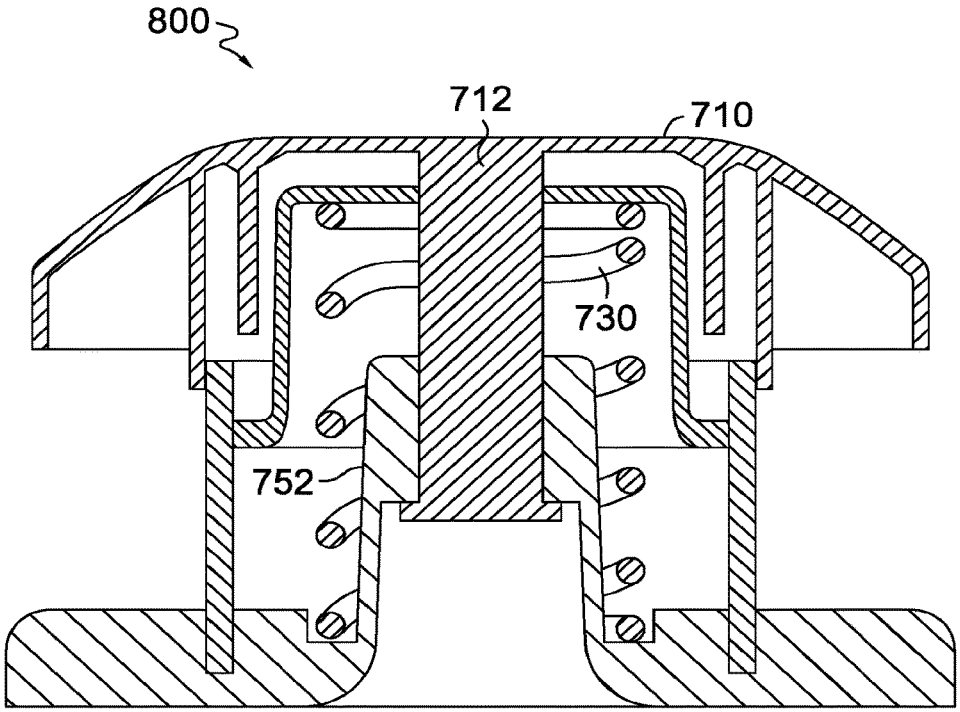
FIG. 8A depicts a cross-sectional view of the motor piece of the spiral art device in a resting position with an expanded spring, in accordance with aspects herein.
Figure 8B:
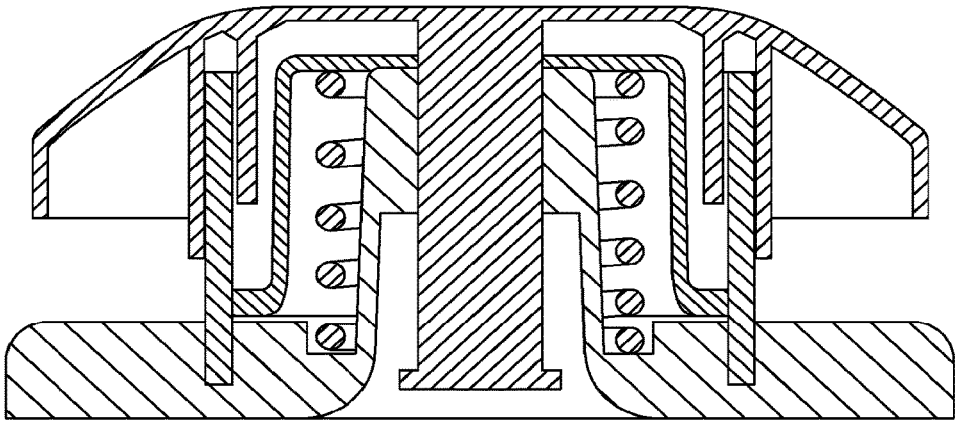
FIG. 8B depicts a cross-sectional view of the motor piece of the spiral art device in an activated position with a compressed spring, in accordance with aspects herein.

FIG. 8A depicts a cross-section 800 of the motor piece 110 in FIG. 1 along the line 8A-8A, when the spring member 730, as shown in FIGS. 7A and 7B, is in its resting configuration (i.e., expanded state). FIG. 8B depicts a cross-section of the motor piece 110 in FIG. 2 along the line 8B-8B, when the spring member 730, as shown in FIGS. 7A and 7B, is in its active configuration (i.e., loaded state/compressed state). As further shown in FIGS. 8A and 8B, the plunger cap member 710 forms, in accordance with aspects herein, a mushroom top shape that is configured to fit into the palm of a user's hand so that the user may exert even pressure on the spring member 730 when pushing down on the plunger cap member 710. In other words, it is believed that the mushroom shape of the plunger cap member 710 is ergonomic. However, other shapes for the plunger cap member 710 are also envisioned such as flat and round, square, oval, or any other shape that is suitable for allowing a user to exert even pressure on the plunger cap member 710, regardless of the angle at which the user may be exerting the pressure on the plunger cap member 710.

Figure 9A:
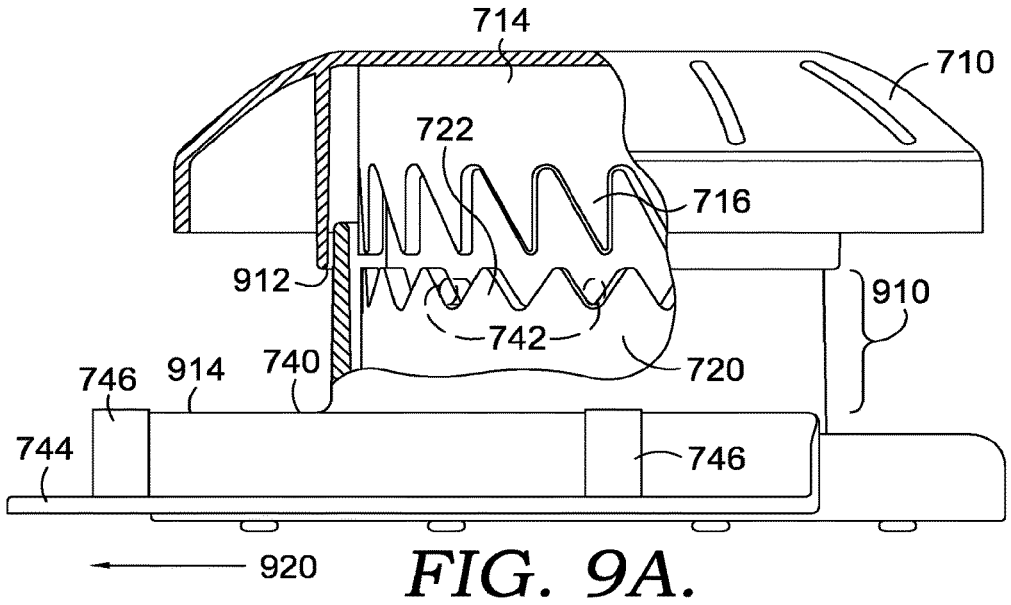
FIGS. 9A to 9E depict a series of cut-out views of the motor piece of the spiral art chalk art device depicting the motion of the template ring member to move the stencil piece a predetermined distance from each starting point, in accordance with aspects herein.

FIGS. 9A to 9E depict the motion of the template ring member 740 when the plunger cap member 710, in FIGS. 7A and 7B, is pressed by the user. For instance, FIG. 9A depicts a cutout view of the motor piece 110 when the motor piece 110 is in its resting state (i.e., the spring member 730 shown in FIGS. 7A and 7B is in its expanded state). For ease of viewing, although the ring pins 742 are internal to the template ring member 740 and therefore not readily viewable, the ring pins 742 are shown in phantom to show their interaction with both the first plurality of cams 722 of the first ring member 720 and the second plurality of cams 716 of the second ring member 714. The first plurality of cams 722 of the first ring member 720 are not aligned with the second plurality of cams 716 of the second ring member 714. In other words, the grooves of the first ring member 720 are aligned with the second plurality of cams 716 of the second ring member 714 and the grooves of the second ring member 714 are aligned with the first plurality of cams 722 of the first ring member 720. As seen, when at rest, the template ring member's 740 platform portion 914 and the plunger element's base portion 912 are separated by a distance 910, the ring pins 742 are engaged with the grooves of the first plurality of cams 722. As the user begins to press on the plunger cap member 710, the distance 910 between the template ring member's 740 platform portion 914 and the plunger element's base portion 912 starts to decrease and the ring pins 742 of the template ring member 740 start to disengage with the first plurality of cams 722 of the first ring member 720 and start engaging with the second plurality of cams 716 of the second ring member 714 of the plunger cap member 710. This interaction of the ring pins 742 of the template ring member 740 with the second plurality of cams 716 of the second ring member 714 initiates a first rotational movement of the template ring member 740. That is, the total rotational distance traveled by the lip portion 744 of the template ring member 740 is influenced by the distance that each of the ring pins 742 travel on each tooth (tooth depth) of the first plurality of cams 722 and the second plurality of cams 716, as well as the angled edge(s) of each tooth of the first plurality of cams 722 and the second plurality of cams 716. As well, the total number of teeth in each of the first plurality of cams 722 and the second plurality of cams 716, respectively, divided by 360 degrees (full rotation around the circumference of a circle), will provide the rotational distance traveled by the lip portion 744 of the template ring member 740 each time the ring pins 742 engage with the first plurality of cams 722 and the second plurality of cams 716.

Figure 9B:
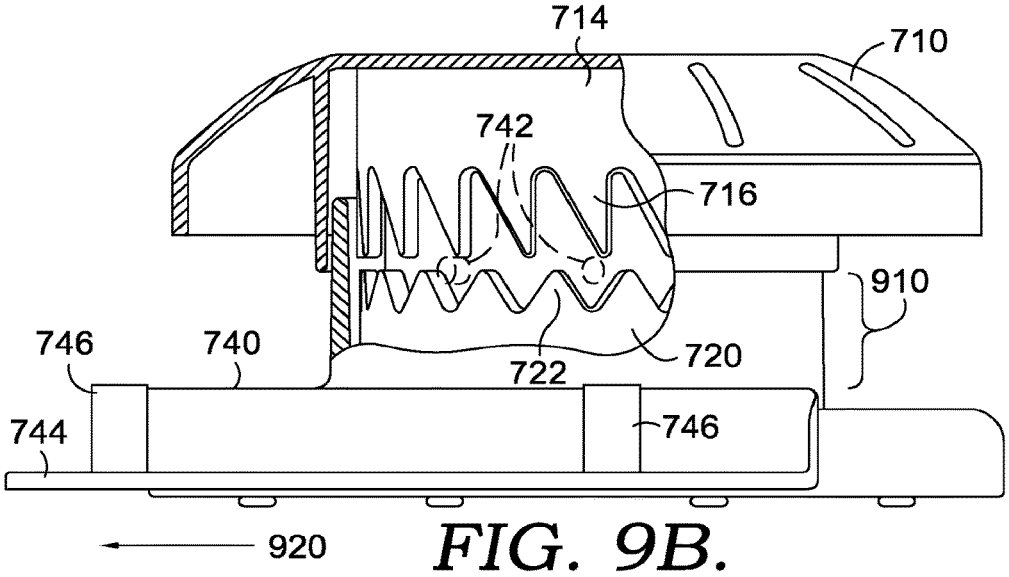
Figure 9C:
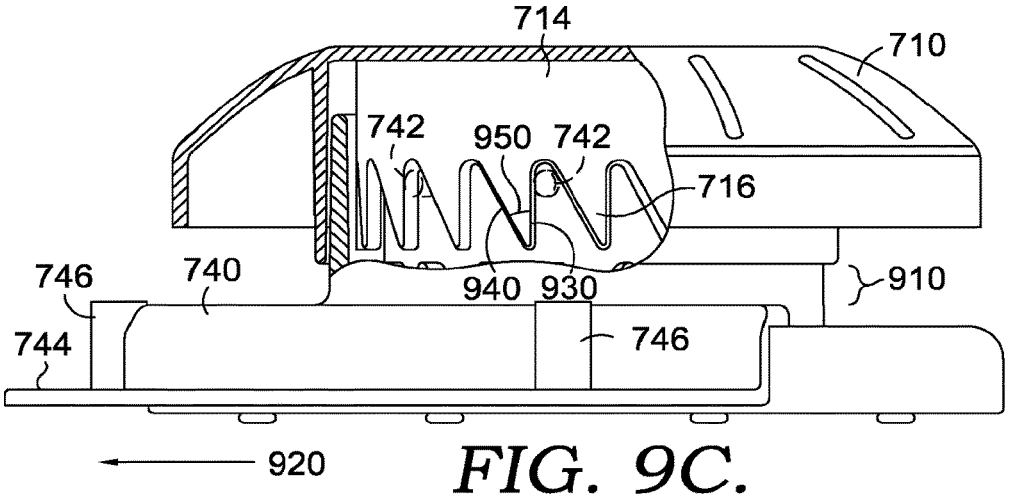

As observed in the exemplary motor piece 110 of FIGS. 9A to 9C, the first rotational movement initiated is in the clockwise direction 920. As better observed in FIG. 9C, the direction of travel of the template ring member 740 is influenced by the shape of the second plurality of cams 716, where each cam in the plurality of cams 716 comprises a first edge 930 that is orthogonal to the platform portion 914 and a second angled edge 940 that is at an angle 950 from the first edge 930. Thus, the angle 950 of the second angled edge 940 influences the ring pins 742 to engage with the second angled edge 940 and induces a first degree of rotation. The first degree of rotation may range between 5 degrees and 30 degrees, between 8 degrees and 25 degrees, or between 12 degrees and 20 degrees. For example, if the angle 950 of the angled edge is 34 degrees, upon the user pressing down on the plunger cap member 710, the ring pins 742 of the template ring member 740 may engage the second plurality of cams 716 having a tooth depth of, for example, 12.8 mm, of the second ring member 714 to rotate the template ring member 12 degrees. Further, the spring member 730, as shown in FIGS. 8A and 8B, becomes compressed, thereby being transitioned from a rest configuration to a loaded configuration.

Figure 9D:
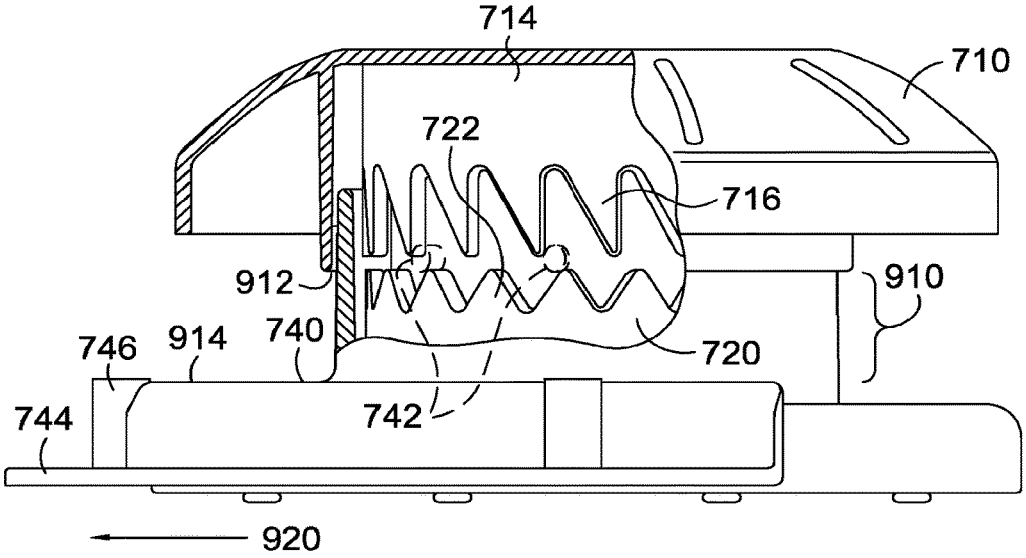
Figure 9E:
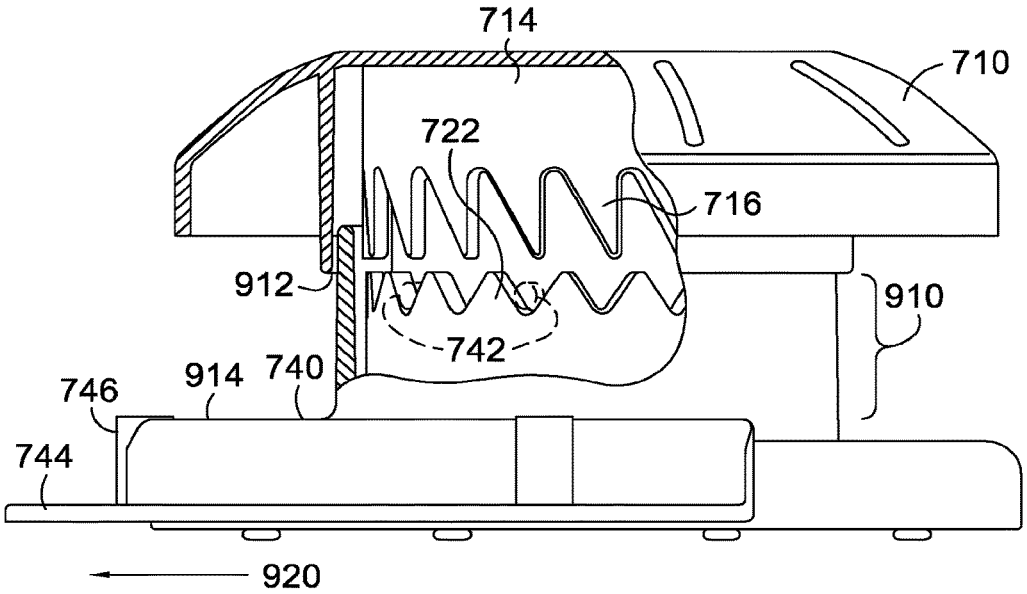
Figure 10:
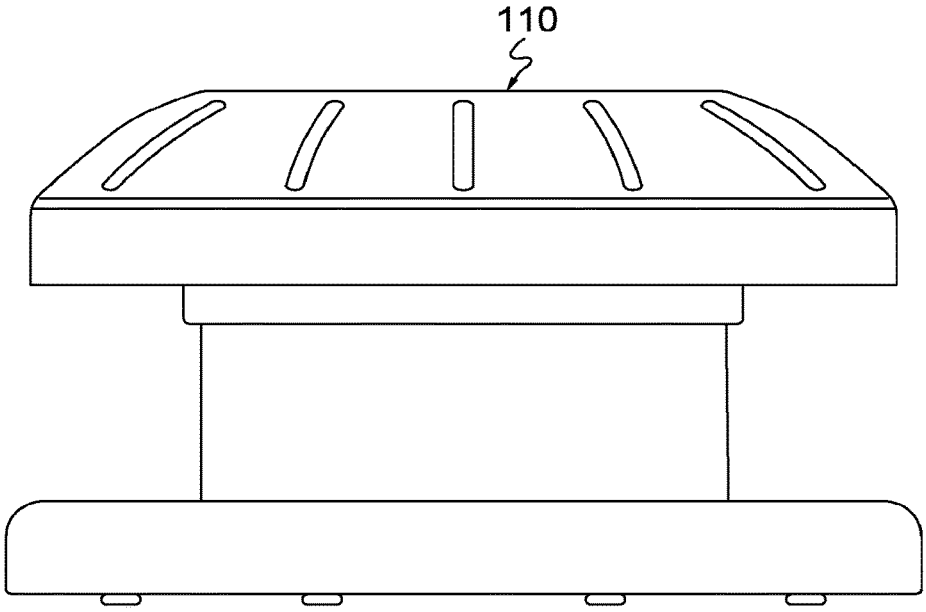
FIG. 10 depicts a back view of the motor piece in accordance with aspects herein, when the template ring member is on the opposite side hidden from view.
Figure 11:
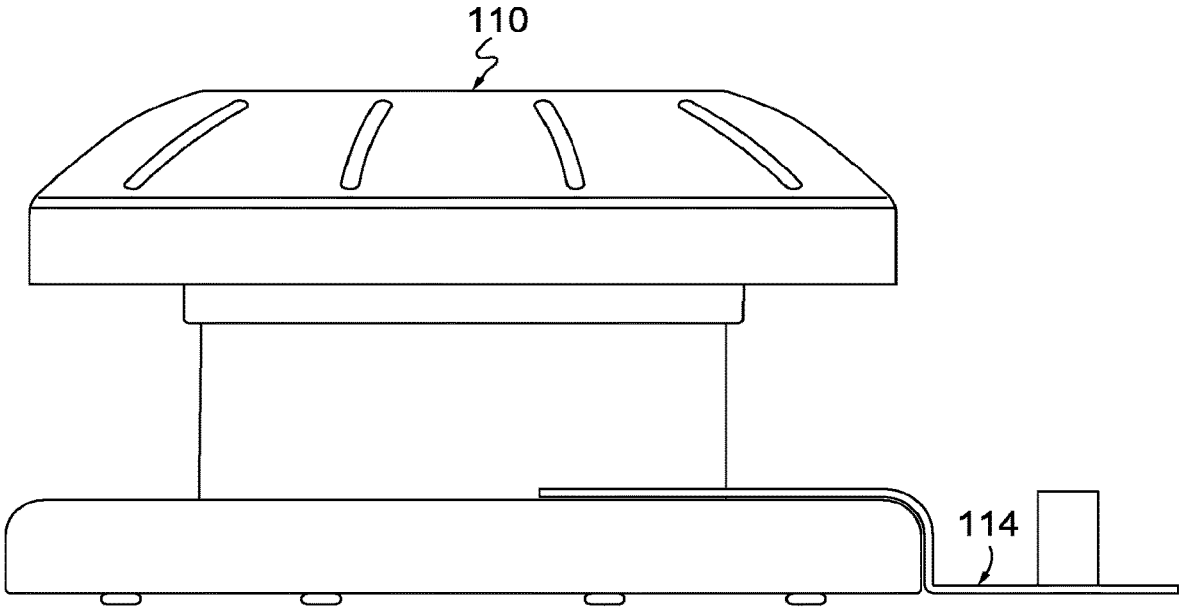
FIG. 11 depicts a side view of the motor piece in accordance with aspects herein, when the template ring member is on one side.

As further observed from FIGS. 9D and 9E, when the user releases the plunger cap member 710 (i.e., stops exerting pressure on the plunger cap member 710), the spring member 730 pushes on the plunger cap member 710 in the opposite direction to the user (i.e., becomes unloaded by releasing the compressing force and returns to its rest configuration and pushes the plunger cap member 710 upward). As the plunger cap member 710 is pushed by the spring member 730, an interaction with the first plurality of cams 722 of the first ring member 720 is initiated. Depending on the tooth depth of the first plurality of cams 722 and depending on the angle measured from vertical of the angled edges of the individual teeth of the first plurality of cams 722, as the first plurality of cams 722 become engaged by the ring pins 742, the template ring member 740 is rotationally moved a second time for a second degree of rotation. The second degree of rotation may range between 2 degrees and 20 degrees, between 4 degrees and 17 degrees, or between 8 degrees and 12 degrees. For example, if the depth of the teeth of the first plurality of cams 722 is, for example, 6 mm, and the angle of each of the angled edges of each tooth is 33 degrees from vertical, upon the spring member 730 pushing up on the plunger cap member 710, the ring pins 742 of the template ring member 740 may engage the first plurality of cams 722 of the first ring member 720 to rotate the template ring member another 8 degrees. In other words, every time the user presses down and releases the plunger cap member 710, the template ring member 740 may become rotated a total of 20 degrees. Thereby, rotationally moving the lip portion 744 carrying the stencil piece (e.g., stencil piece 120 in FIG. 1) 20 degrees from its initial location. Finally, FIG. 10 depicts a back view of the motor piece 110 when the lip portion of the template ring member 114 is on the opposite side hidden from view and, FIG. 11 is a side view of the motor piece 110 when the lip portion of the template ring member 114 is on one side of the motor piece 110.

As briefly described above, although not shown, an adjustment mechanism for controlling the rotational distance traveled by the template ring member may be provided. The adjustment mechanism may, for example, adjust an extent of engagement of the ring pins with the first plurality of cams of the first ring member and the second plurality of cams of the second ring member. In other words, an adjustment mechanism may be provided where the level of compression of the spring member may be adjusted so that the rotational distance traveled by the template ring member is adjusted to a desired degree, with full compression of the spring allowing for the maximum distance. As well, an indexing mechanism may be provided, for example, for allowing a user to develop designing steps. The indexing mechanism may allow the user to use multiple stencil pieces and remind the user when to alternate stencils, especially when recreating a previously completed design.

Since many possible embodiments may be made of the technology described herein without departing from the scope thereof, it is to be understood that all matter herein set forth or shown in the accompanying drawings is to be interpreted as illustrative and not in a limiting sense.

The invention claimed is:

1. A spiral art device comprising:

a removable stencil piece comprising:

(1) a traceable opening; and (2) at least two locking openings; and a motor piece comprising:

(1) a base member having a first central elongated stem portion;

(2) a template ring member comprising a template arm on an exterior surface, the template arm having at least two stencil locking pins;

(3) a first ring member having a first plurality of cams evenly distributed around a first circumference of the first ring member, wherein the first plurality of cams point in a first direction;

(4) a second ring member having a second plurality of cams evenly distributed around a second circumference of the second ring member, wherein the second plurality of cams point in a second direction that is opposite to the first direction;

(5) a spring member;

(6) a plunger cap member; and (7) a locking cap member.

2. The spiral art device of claim 1, wherein the second ring member is an integral part of the plunger cap member.

3. The spiral art device of claim 1, wherein the traceable opening of the removable stencil piece comprises one of a geometric shape, an organic shape, or an animal shape.

4. The spiral art device of claim 1, wherein a perimeter of the removable stencil piece comprises one or more of a curved edge, a straight edge, a jagged edge, and a wavy edge.

5. The spiral art device of claim 1, wherein the removable stencil piece's longest dimension measures between 10 cm and 50 cm in length, and wherein the removable stencil piece's widest dimension measures between 3 cm and 10 cm in width.

6. The spiral art device of claim 1, wherein the base member comprises one or more gripping/cushioning feet on a first surface that is configured to be a ground-contacting surface.

7. The spiral art device of claim 6, wherein the base member comprises alternating reference symbols on a second surface that is configured to face a user when the spiral art device is in use.

8. The spiral art device of claim 1, wherein the template ring member further comprises a plurality of pin elements on an interior surface of the template ring member, wherein the plurality of pin elements are configured to alternately engage with the first plurality of cams of the first ring member and the second plurality of cams of the second ring member.

9. The spiral art device of claim 1, wherein the spring member is comprised of one of a metal, a plastic, a coated metal, and a thermoplastic coated metal.

10. The spiral art device of claim 1, wherein the first central elongated stem portion of the base member comprises an opening, and wherein the plunger cap member comprises a second central elongated stem portion that is configured to slide into the opening of the first central elongated stem portion.

11. A spiral art device system kit comprising:

a plurality of colored chalk pieces;

a plurality of interchangeable stencil pieces, each interchangeable stencil piece comprising:

(1) a traceable opening;

(2) a traceable edge; and (3) a plurality of locking openings; and a motor piece comprising:

(1) a base member having a first central elongated stem portion, the first central elongated stem portion comprising an opening;

(2) a template ring member comprising an interior surface and an exterior surface, the interior surface comprising a first plurality of pins, and the exterior surface comprising a template arm with a second plurality of pins;

(3) a cam ring member comprising a first plurality of cams evenly distributed around a first circumference of the first ring member, wherein the first plurality of cams point in a first direction;

(4) a plunger cap member comprising a first surface and a second surface, the second surface of the plunger cap member comprising a ring portion having a second plurality of cams protruding from the second surface of the plunger portion in a second direction that is opposite to the first direction, wherein the second plurality of cams are evenly distributed around the circumference of the ring portion, and a second central elongated stem portion fitted into the opening of the first central elongated stem portion; and (5) a spring member.

12. The spiral art device system kit of claim 11, wherein the first surface of the plunger cap member is a user-contacting surface when the spiral art device is in use.

13. The spiral art device system kit of claim 12, wherein the template ring member is configured to rotate a first distance when the first plurality of pins are engaged with the first plurality of cams, and rotate a second distance when the first plurality of pins are engaged with the second plurality of cams.

14. The spiral art device system kit of claim 13, wherein the second plurality of pins are configured to engage with two or more of the plurality of locking openings of a first interchangeable stencil piece in the plurality of interchangeable stencil pieces.

15. The spiral art device system kit of claim 14, wherein the first interchangeable stencil piece may be engaged with the motor piece at different angles.

16. The spiral art device system kit of claim 11, wherein the plurality of locking openings are hexagonally shaped.

17. The spiral art device system kit of claim 11, wherein the second plurality of pins have a circular cross-section.

18. The spiral art device system kit of claim 11, wherein the first plurality of cams and the second plurality of cams face each other, and wherein the first plurality of cams are not aligned with the second plurality of cams.

19. The spiral art device system kit of claim 11, wherein when in a rest state, the spring member is in an expanded state and the first plurality of pins are engaged with the first plurality of cams, and wherein when in the spring is in a compressed state, the first plurality of pins become engaged with the second plurality of cams, causing the template ring to rotate.

20. A motor piece for a spiral art device comprising:

a base member having a first central elongated stem portion, the first central elongated stem portion comprising an opening;

a template ring member comprising an interior surface and an exterior surface, the interior surface comprising a first plurality of pins, and the exterior surface comprising a template arm with a second plurality of pins;

a cam ring member comprising a first plurality of cams evenly distributed around a first circumference of the first ring member, wherein the first plurality of cams point in a first direction;

a plunger cap member comprising a first surface and a second surface, the second surface of the plunger cap member comprising a ring portion having a second plurality of cams protruding from the second surface of the plunger portion in a second direction that is opposite to the first direction, wherein the second plurality of cams are evenly distributed around the circumference of the ring portion, and a second central elongated stem portion fitted into the opening of the first central elongated stem portion; and a spring member.

* * * * *